United States Patent [19]

Ernst

[11] 3,961,860

[45] June 8, 1976

[54] PROPORTIONING PUMP

[75] Inventor: Franz Ernst, Aglasterhausen, Germany

[73] Assignee: Chemie and Filter GmbH, Heidelberg, Germany

[22] Filed: Mar. 3, 1975

[21] Appl. No.: 554,651

Related U.S. Application Data

[63] Continuation of Ser. No. 258,977, June 2, 1972, abandoned.

[30] Foreign Application Priority Data

June 15, 1971 Germany ..... 2129588

[52] U.S. Cl. ..... 417/44; 417/388

[51] Int. Cl.[2] ..... F04B 9/10

[58] Field of Search ..... 417/383, 384, 385, 386, 417/387, 388, 389, 390; 60/538, 545, 590, 591

[56] References Cited

UNITED STATES PATENTS

| | | | |
|---|---|---|---|
| 2,673,522 | 3/1954 | Dickey | 417/388 |
| 2,844,227 | 7/1958 | Armstrong | 60/590 |
| 3,101,058 | 8/1963 | Carr et al. | 417/388 |
| 3,151,562 | 10/1964 | Swartz | 417/388 |

FOREIGN PATENTS OR APPLICATIONS

| | | | |
|---|---|---|---|
| 642,592 | 7/1962 | Italy | 417/386 |
| 324,093 | 1/1930 | United Kingdom | 60/591 |

*Primary Examiner*—C. J. Husar
*Assistant Examiner*—Leonard Smith

[57] ABSTRACT

The invention relates to a metering pump assembly having a reciprocable pump element with an adjustable stroke. The pump assembly includes a hydraulic system with two adjustable volume chambers, one chamber being associated with the pump element and the other with a displaceable element having an electromagnetic drive. Adjustable throttle means are provided between the two chambers for adjusting the stroke of the pump element in accordance with the setting of the throttle means.

10 Claims, 3 Drawing Figures

PROPORTIONING PUMP

Figures 1, 2:
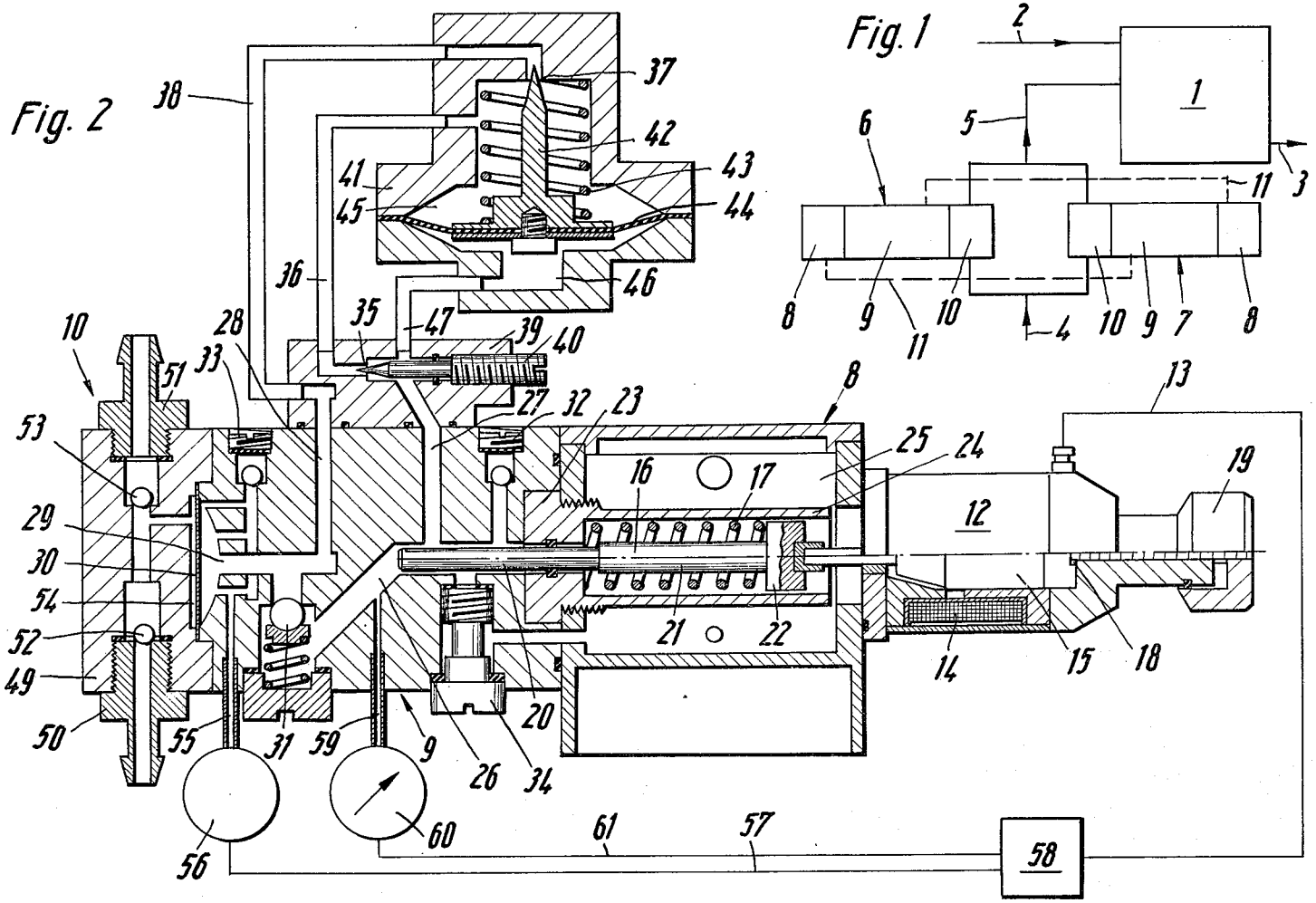

This is a continuation of application Ser. No. 258,977, filed June 2, 1972 now abandoned.

The invention relates to a proportioning pump comprising a reciprocatable pump element of which the forward speed is adjustable.

It is often necessary to feed a small quantity of proportioned material, for example a few cubic centimeters per hour, continuously and selectively into a process. For this purpose a proportioning pump is known comprising a piston which is adjusted by a cam plate. The cam plate is driven through controllable intermediate gearing by a continuously rotating motor. However, the motor, controllable gearing and cam plate drive make such a proportioning pump complex and expensive.

The invention aims to provide a proportioning pump of the aforementioned kind which permits the same proportioning effect to be achieved with less equipment and at lower costs.

This problem is solved in accordance with the invention by a hydraulic system comprising a first chamber of which the volume is adjustable with the aid of a primary compressor element which is adjustable to and fro by a power drive, a second chamber associated with the drive side of the pump element and adjustable throttle means which interconnect both chambers at least during forward operation.

For this one does not require a rotary motor as a drive but a simple power drive, that is to say for example a pneumatic axial motor which can be connected to a source of constant pressure. The force thereby acting on the primary compressor element results, in connection with the adjustable throttle means between the first and second chambers, in a continuous adjustment of the pump element, the adjusting speed being dependent on the setting of the throttle means. This results in a very simple and cheap construction of the proportioning pump.

It is of particular advantage if the power drive of the primary compressor element is an electromagnet of which the armature is counteracted by a spring. An electromagnet can be energised and de-energised by a simple switch, for example a terminal switch. It is also immaterial that during its stroke the electromagnet does not exert a constant force on the primary compressor element because it is not difficult to compensate such force differentials in the hydraulic and/or electric system.

The primary compressor element can for example comprise a piston. Such a piston is displaceable through comparatively long distances by the prime mover. Nevertheless, with a small diameter for the piston the compressed quantity of fluid can be kept small. In addition, the axial displacement of the piston can if necessary be limited to a certain value.

The pump element may be a diaphragm. The diaphragm is an easily movable element which separates the second chamber from the pump chamber. As a result, compression in the pump chamber follows an increase in volume of the second chamber without delay. The pump element may also be bellows or a piston. The piston can, in turn, give rise to the pumping effect directly or drive a special pump head.

Often it is also advisable that the adjustable throttle means are bridged by a valve which opens during the return operation. This valve may be a pressure-controlled return valve. But it may also be an electromagnetically actuated valve which opens in dependence on a parameter which characterises the end of the forward operation. In any case, this valve permits the pump element, the primary compressor element and the power drive to return rapidly to the initial position because return movement is effected without throttling. If another forward stroke is commenced immediately thereafter, the interruption in the continuous supply of proportioned material is generally so short that it is acceptable without disadvantage.

However, if the continuous supply of proportioned material is not to be interrupted at all, one can provide at least two pump elements with associated hydraulic system and ensure that a parameter characterising the end of the forward operation of the one system is instrumental in switching on the power drive of the other system. During return movement of the one system, the other system is then effective for supplying the proportioned material.

The parameter characterising the end of forward operation can for example be an electric signal derived from a terminal switch, an approach initiator or the like. The signal may also be derived from the hydraulic fluid flowing through the throttle means, or the like.

The throttle means may comprise a throttle which can be adjusted from the outside at will. Each adjustment of this throttle results directly and without change of the power drive in a change in the forward speed of the pump element.

For the purpose of very fine adjustment, the throttle which is adjustable at will may comprise a finely adjustable needle valve.

It is particularly advantageous if the throttle means comprise a throttle which is adjustable at a measuring screen in dependence on the pressure drop. Such a throttle permits the flow speed of the hydraulic fluid through the measuring screen when passing from the first into the second chamber to be kept substantially constant even if the drive force acting on the primary compressor element does not happen to be constant throughout the stroke. Adjustment can in this case be effected for example in that the desired value of the pressure drop can be set at will from the outside by means of a desired value spring.

It is particularly favourable in this connection if the throttle which is adjustable at will from the outside is used as the measuring screen. The throttle resistance is then divided into the throttle which is adjustable at will from the outside and the throttle which is adjustable by the pressure drop. Together, they form adjustable throttle means. Of course a fixed throttle may additionally be provided in the flow path for use merely in producing an additional throttle resistance and/or as a measuring screen.

The accuracy with which the proportioning pump operates can be further increased by a pressure regulator connected to the first chamber, the pressure regulator controlling the power supply to the power drive in such a way that the hydraulic pressure in the first chamber remains substantially constant. This is particularly applicable to an electromagnet in which the energising current that is to be supplied can be regulated in dependence on the pressure of the first chamber. It is also desirable if the armature of the driving electromagnet is associated with a stop by means of which the stroke of the armature is adjustable. In this way the quantity of proportioned material to be conveyed per stroke can be conveniently set. Instead of a mechanical abutment it is also possible to use an electronic approach initiator. Such an approach initiator may also cause direct switching of the forward operation.

Figure 3:
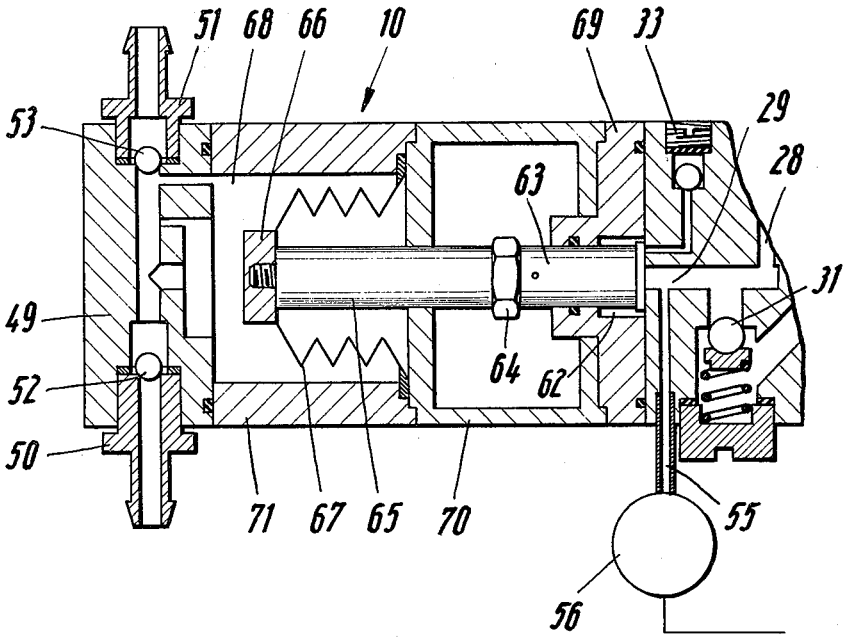

The invention will now be described in greater detail in conjunction with the drawing. In the drawing FIG. 1 is a diagram showing the connection of a proportioning pump according to the invention to a chemical plant;

FIG. 2 is a part-sectional diagrammatic elevation showing the construction of the proportioning pump unit, and FIG. 3 is a modified pump.

A medium supplied through a supply 2 and withdrawn through a delivery 3 is to be mixed in a vessel 1 with proportioning material which is continuously supplied in small quantities. The medium may for example be water for industrial purposes and the proportioned material may be phosphate for decalcification. The proportion material may however also serve to bring about some sort of chemical reaction in a chemical process.

The proportioned material is supplied from a storage vessel (not shown) through a conduit 4 and dispensed into the vessel 1 through a connection 5. Two proportioning pumps 6 and 7 are provided, each consisting of three parts, namely a drive portion 8, a hydraulic portion 9 and a pump portion 10. Impulse lines 11 indicate that whenever the forward stroke of a pump has been terminated the drive portion 8 of the other pump will be switched on. In the meantime the first-mentioned pump can return to its initial position.

In the pump shown in FIG. 2 the drive portion 8 comprises an electromagnet 12 having a coil 14 which is energised through a line 13 and an armature 15. This armature drives a primary compressor element 16 which is counteracted by a return spring 17. Under the influence of this spring the armature can move against a stop 18 (initial rest position) formed by the front end of a set screw 19. The primary compressor element 16 has a piston 20, a central section 21 and a collar 22. The piston 20 is guided in a housing portion 23 and the collar 22 in a cylindrical extension 24 of this housing portion. The latter projects into a chamber 25 which may for example serve as a store for hydraulic fluid. The piston 20 of the compressor element 16 projects into a first chamber 26 of the hydraulic portion 9. This hydraulic portion is connected through a passage 27, throttle means to be described hereinafter and a passage 28 to a second chamber 29 of which one bounding wall is formed by a diaphragm 30 which constitutes a pump element. In addition the second chamber 29 is connected to the first chamber 26 through a return valve 31. Each chamber has a ventilating screw 32 and 33. In addition a follow-on valve 34 is provided for replenishing the hydraulic portion with hydraulic fluid from the chamber 25. The adjustable throttle means comprise a first throttle 35 connected by a conduit 36 to a second throttle 37. The latter leads to the passage 28 through a conduit 38. The first throttle has a housing 39 and a finely adjustable needle valve 40. In this way the throttle 35 can be adjusted at will from the outside. The second throttle 37 has a housing 41 and a throttle member 42 which on the one hand is loaded by a desired value spring 43 and on the other hand by a diaphragm 44. This diaphragm is influenced by the differences in the pressures in the two chambers 45 and 46. The latter is connected to the passage 27 by a conduit 47. The second throttle 37 is therefore controlled in dependence on the pressure drop at the first throttle 35 because the chamber 45 corresponds to the pressure behind the first throttle 35 and the pressure in the chamber 46 corresponds to the pressure in front of the first throttle.

The pump portion 10 has a housing 49 with a supply connection 50 and a delivery connection 51, a suction valve 52, a pressure valve 53 and a pump chamber 54 disposed therebetween bounded on one side by the diaphragm 30.

A pressure gauge 56 is connected to the second chamber through a conduit 55. With its help a signal can be delivered through an impulse line 57 to a switching appliance 58 if the pressure in the second chamber 29 increases to beyond a predetermined value as a result of a blockage or the like. The switching appliance 58 can switch the electromagnet 12 off.

A pressure gauge 60 is connected to the first chamber 26 through a conduit 59 and it indicates the existing pressure to the switching appliance 48 through an impulse line 61. If it is desired to keep the pressure in the first chamber 26 permanently constant but the power drive which is here in the form of an electromagnet produces a force which varies with the stroke when there is a constant current supply, the switching appliance can in this way control the current for the electromagnet so that the force with which the piston 20 is pushed into the chamber 26 remains substantially constant.

The drawing illustrates the arrangement at the end of its forward movement. When, with the aid of the pressure gauge 56, the end of this forward movement is indicated and the electromagnet 12 has been switched off, the primary compressor element 16 returns, under the influence of the spring 17, to the initial position determined by the stop 18. This return movement can proceed rapidly because the return valve 31 opens and the second chamber 29 is connected to the first chamber 26 over a large cross-sectional area. During this stage the diaphragm 30 is pulled to the right into the chamber 29. This enlarges the pump chamber 54 and proportioned material is sucked through the connection 50 and the suction valve 52. When the electromagnet 12 is now switched on again, it pulls its armature 15 towards the left whereby the piston 20 is pushed into the first chamber 26 by a force which is predetermined by the working characteristic of the magnet. This causes hydraulic fluid to be pressed through the two throttles 35, 37 from the first chamber 26 into the second chamber 29. The diaphragm 30 is displaced to the left as a result. The pump chamber 30 is decreased and the proportioned material is continuously fed through the pressure valve 53 and the connection 51 into the vessel. This feeding is terminated when the armature 15 strikes the magnet and this condition is indicated by a corresponding pressure drop in the second chamber 29. The work cycle is thereupon repeated.

The feeding speed of the proportioned material can be changed by a simple adjustment of the valve needle 40 of the first throttle 35.

A still higher accuracy is obtained if the current of the electromagnet is also controlled in dependence on the pressure in the first chamber 26.

If, as shown in FIG. 1, two such pumps 6 and 7 are used then the pressure gauge 56 gives a signal not only to the switching appliance 58 for switching off the electromagnet 12 of the pump just operated but also a further signal to the switching appliance of the other pump to energise the electromagnet thereof. In this case the continuous feeding of the proportioned material is not interrupted during the return movement of the piston 20. The electromagnet 12 remains de-energised until the other pump has finished its forward stroke.

In FIG. 3 the actual pump portion 10 is different from that in FIG. 2 whilst the hydraulic system is to have the same construction. For this reason the same reference numerals are used for the same or similar parts.

The second chamber 29 has a cylindrical extension 62 in which a piston 63 is movable. This piston is connected by a screw connection 64 to a piston extension 65 which drives the base 66 of folding bellows 67. The folding bellows are mounted in the actual conveying chamber 63. The described parts are accommodated in housing sections 69, 70 and 71. In much the same way as in FIG. 2, a housing 49 is adjacent the front end of the conveying chamber 38.

During operation the piston 63 is slowly displaced to the left when the electromagnet 12 is energised. This causes the folding bellows 67 to be pressed further into the interior of the conveying chamber 68 whereby the proportioned material is conveyed out of the connection 51. On the return stroke the proportioned material is sucked in through the connection 50.

Instead of an electromagnet as the power drive use can also be made of pneumatic drive means, i.e., a linear motor fed from a source of constant pressure, a diaphragm or bellows operative element and the like. It could also be a simple weight which is pulled upwardly and is slowly lowered during pumping.

I claim:

1. A metering pump unit comprising a first pumping means having a movable pumping element which provides first and second oppositely expanding and contracting chambers on opposite sides thereof, inlet and outlet valve means for said first chamber to effect the flow of fluid into and out of said first chamber upon the respective expansion and contraction thereof, second pumping means and an expansible chamber, parallel supply and return fluid paths between said expansible chamber of said second pumping means and said second chamber of said first pumping means, adjustable throttle means in said supply path for varying the quantity of a fluid delivered to said second chamber per time unit during the forward stroke of said second pumping means, and one way valve means in said return path.

2. A metering pump unit according to claim 1 wherein said second pumping means has a displacement element which is a piston.

3. A metering pump unit according to claim 1 wherein said movable pump element is a diaphragm.

4. A metering pump unit according to claim 1 wherein said pump element includes a combination piston and bellows displacement member.

5. A metering pump unit according to claim 1 wherein said one way valve means is pressure controlled.

6. A metering pump unit according to claim 1, a second metering pump unit substantially identical to said first described metering pump unit, and means for causing a push-pull operation wherein the end of the forward operation of one unit switches on a power drive for said second pumping means of the other unit.

7. A metering pump unit according to claim 1 wherein said throttle means includes a finely adjustable needle valve.

8. A metering pump unit according to claim 1 wherein said throttle means includes manually and automatically adjustable throttle units in series, said automatically adjustable unit being variable in accordance with the pressure drop across said manually adjustable unit.

9. A metering pump unit according to claim 1 including a motor for said displacement element, pressure regulator means between said first chamber and said motor which is responsive to the pressure in said first chamber to control said motor to maintain a substantially constant pressure in said first chamber.

10. A metering pump unit according to claim 1 including stop means for armature of an electromagnet connected to said second pumping means whereby the stroke thereof is adjustable.

* * * * *